United States Patent [19]

Aoi et al.

[11] Patent Number: 4,679,532

[45] Date of Patent: Jul. 14, 1987

[54] VALVE ARRANGEMENT FOR INTERNAL COMBUSTION ENGINE

[75] Inventors: Kazuo Aoi, Hamamatsu; Naoki Tsuchida, Iwata, both of Japan

[73] Assignee: Yamaha Hatsudoki Kabushiki Kaisha, Iwata, Japan

[21] Appl. No.: 764,880

[22] Filed: Aug. 12, 1985

[30] Foreign Application Priority Data

Aug. 15, 1984 [JP] Japan ..... 59-169375

[51] Int. Cl.[4] ..... F01L 1/26

[52] U.S. Cl. ..... 123/90.22; 123/90.27; 123/308; 123/315

[58] Field of Search ..... 123/90.27, 90.4, 90.22, 123/90.23, 308, 315

[56] References Cited

U.S. PATENT DOCUMENTS

| | | | |
|---|---|---|---|
| 4,363,300 | 12/1982 | Honda | 123/90.27 |
| 4,471,730 | 9/1984 | Honda | 123/90.27 |
| 4,549,510 | 10/1985 | Miyakoshi et al. | 123/90.27 |
| 4,558,667 | 12/1985 | Inagaki et al. | 123/90.22 |

FOREIGN PATENT DOCUMENTS

| | | | |
|---|---|---|---|
| 186009 | 11/1982 | Japan | 123/90.27 |
| 210126 | 12/1982 | Japan | 123/90.27 |
| 172422 | 10/1983 | Japan | 123/90.27 |
| 18217 | 1/1984 | Japan | 123/90.27 |

*Primary Examiner*—Ira S. Lazarus

*Attorney, Agent, or Firm*—Ernest A. Beutler

[57] ABSTRACT

A valve placement arrangement for an internal combustion engine including at least three intake valves and two exhaust valves and wherein no two of the exhaust valves are adjacent to each other and they are separated by intake valves so as to insure against undue heating and minimize thermo-loading.

7 Claims, 2 Drawing Figures

VALVE ARRANGEMENT FOR INTERNAL COMBUSTION ENGINE

BACKGROUND OF THE INVENTION

This invention relates to a valve arrangement for an internal combustion engine and more particularly to an improved valve and porting arrangement for a multiple valve internal combustion engine.

It is well known that the volumetric efficiency and output of an internal combustion engine can be improved by employing plural valves for each combustion chamber of the engine. By utilizing more than two intake and/or exhaust valves, it is possible to obtain a greater valve area for a given surface area of the combustion chamber and also to increase engine operating speeds due to the reduced inertia of the individual valve train components. For this reason, it has been the practice to employ four valve per cylinder, cylinder head assemblies for high performance engines. Recently, it has been proposed to utilize an even greater number of valves such as five valves per cylinder. Such five valve arrangement may employ three intake valves and two exhaust valves. With the normal valve placement of engines of this type, the intake valves have been positioned so as to lie on substantially one side of a plane containing the axis of the cylinder bore while the exhaust valves lie on the other side of this plane. Although such an arrangement affords the opportunity of relatively uncomplicated valve actuation, it presents certain difficulties.

In connection with the use of plural valves per combustion chamber, the increase in effective valve size is accompanied by a very close placement of the individual valves one to the other. If the exhaust valves are disposed as aforenoted (on one side of the plane containing the cylinder bore axis), they will be positioned in close proximity to each other. This means that the individual valve seats and, specifically, the exhaust valve seats are very closely disposed and a very small bridging area extends between the individual valve seats. As a result, this bridging area can become highly heated and can cause many problems.

It is, therefore, a principal object of this invention to provide an improved valve and porting arrangement for an internal combustion engine.

It is a yet further object of this invention to provide a valve and porting arrangement for an internal combustion engine that permits the use of multiple valves while avoids undue heating of the exhaust valve area.

It is another object of this invention to provide an improved exhaust valve placement for a multiple valve engine wherein the exhaust valves are not positioned in close proximity to each other.

SUMMARY OF THE INVENTION

This invention is adapted to be embodied in a valve arrangement for an internal combustion engine having a combustion chamber, at least three intake valves serving the combustion chamber and at least two exhaust valves serving the combustion chamber. In accordance with the invention, no two of the exhaust valves are positioned adjacent to each other.

DETAILED DESCRIPTION OF THE PREFERRED EMBODIMENT

Figure 1:
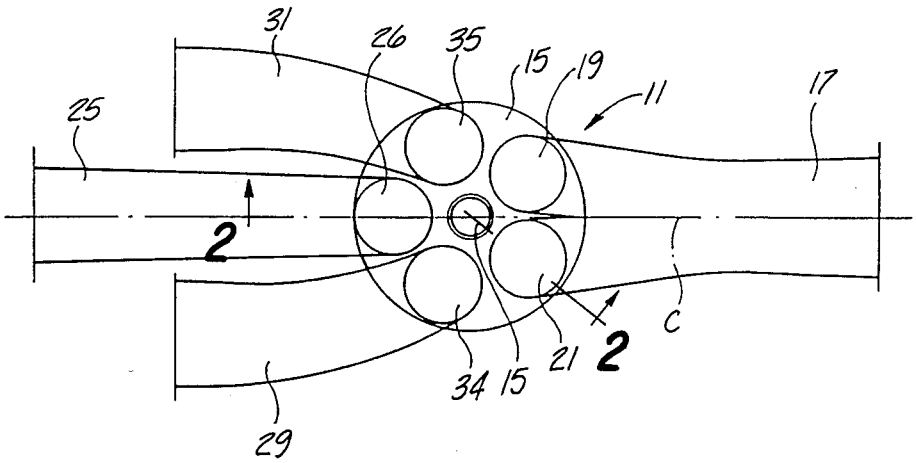
FIG. 1 is a schematic view showing the underside of a combustion chamber embodying a valve and porting arrangement constructed in accordance with an embodiment of the invention.
Figure 2:
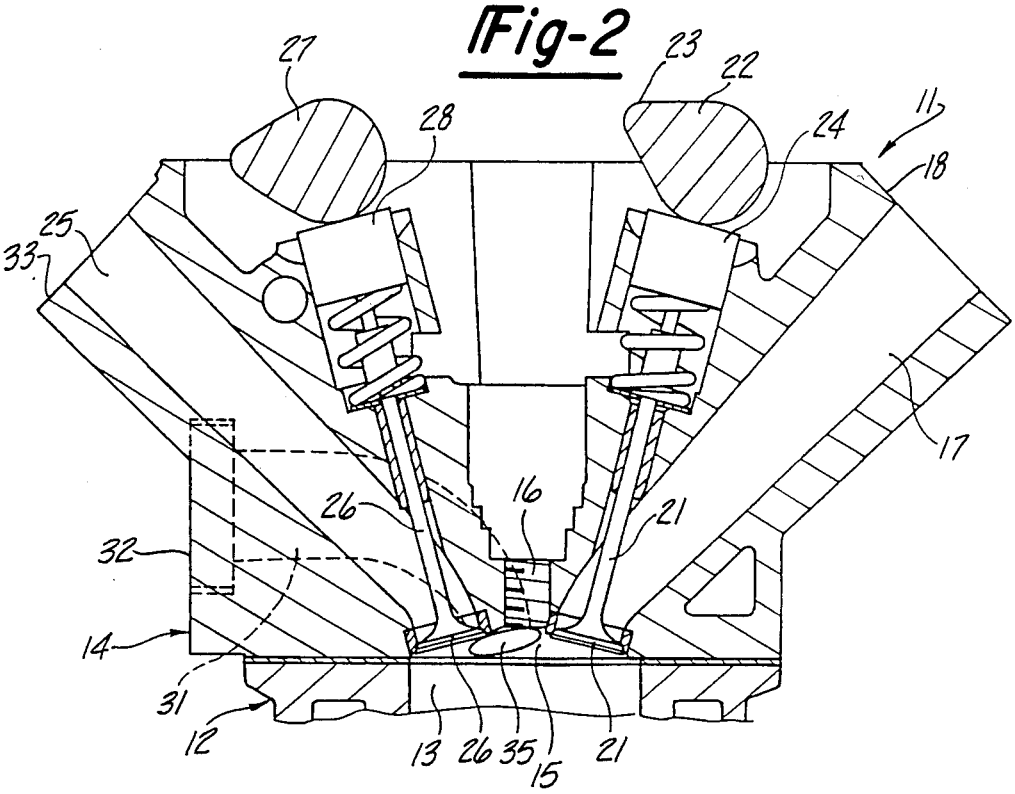
FIG. 2 is a cross-sectional view taken generally along the line 2—2 of FIG. 1 and shows the construction of the components of the engine associated with the valve mechanism.

In the drawings, the reference numeral 11 indicates generally an internal combustion engine constructed in accordance with an embodiment of the invention. In as much as the invention relates to the valve placement and associated porting system, only this portion of the engine has been shown in detail in connection with its association with a single cylinder of the engine. It is believed that the application of this principle to multiple cylinder engines of varying types should be readily apparent to those skilled in the art from the following description.

The engine 11 includes a cylinder block 12 having a cylinder bore 13 in which a piston (not shown) is supported for reciprocation and coupled by means of a connecting rod to a crankshaft in a known manner.

A cylinder head assembly, indicated generally by the reference numeral 14 is affixed to the cylinder block 12 in a known manner and has a cavity 15 that cooperates with the cylinder bore 13 and its associated piston to form a chamber of varying volume, which chamber is referred to as the combustion chamber. A spark plug 16 is positioned in the cylinder head 14 generally on the axis of the cylinder bore 13. The spark plug 16 is fired in any known manner.

The engine 11 is provided with an induction system that includes a first intake passage 17 that extends through one side of the cylinder head assembly 14 from an upper surface 18 thereof and which terminates in a pair of sections each of which ends in a valve seat. Respective intake valves 19 and 21 cooperate with these valve seats to control the flow of an intake charge into the combustion chamber 15 from the intake passage 17. The valve seats with which the intake valves 19 and 21 are disposed on opposite sides of a first plane C passing through the center of the cylinder bore axis 15 and through the center of the intake passage 17. In addition, the intake valves 19 and 21 are disposed on one side of a plane perpendicular to the plane C and passing through the cylinder bore axis.

A first camshaft 22 is rotatably journaled by the cylinder head 14 in a suitable manner and has cam lobes 23 each of which cooperate with respective tappet followers 24 that are slidably supported in the cylinder head assembly 14 for operating the intake valves 19 and 21 in a known manner.

Another intake passage 25 is formed in the cylinder head 14 on the side opposite to the intake passage 17 and which terminates in a respective valve seat. A third intake valve 26 cooperates with this valve seat so as to control the flow of an intake charge into the chamber 15 through the intake passage 25. The valve seat and passage 25 is bisected by the plane C and the intake valve 26 is disposed on the opposite side of the perpendicular plane from the intake valves 19 and 21. The intake valve 26 is operated by means of a second camshaft 27 that is journaled in the cylinder head assembly 14 and which operates a thimble tappet 28 that is slidably supported in the cylinder head 14 for operating the valve 26 in a known manner.

A suitable charge former and/or induction system including carburetors is provided for delivering a charge to the intake passages 17 and 25. Since the specific charge formers and manifold outside of the porting arrangement described form no part of this invention, they have not been illustrated and will not be described further.

A pair of exhaust passages 29 and 31 extend through the cylinder head 14 on opposite sides of the intake passage 25. The exhaust passages 29 and 31 extend from a side face 32 of the cylinder head 14 while the intake passage 25 extends from an upper face 33 thereof. In this way, suitable manifolding may be provided for the respective intake and exhaust passages 25, 29 and 31 without interfering with each other and while minimizing the transmission of heat therebetween.

The exhaust passages 29 and 31 terminate at respective valve seats that are disposed on opposite sides of the plane C and substantially on the opposite side of the perpendicular plane from the intake valves 19 and 21. The exhaust valve seats, however, extend slightly over this plane so that a portion of them will lie on the same side as the intake valves 19 and 21.

Exhaust valves 34 and 35 are slidably supported by the cylinder head assembly 14 in a known manner and cooperate with these exhaust valve seats so as to control the flow of exhaust gases from the combustion chamber 15 into the exhaust passages 29 and 31. The exhaust valves 34 and 35 may be operated from the camshaft 27 through lobes which are offset from the lobe that operates the intake valve 26 due to the different valve timing. Any suitable actuating mechanism may be employed for operating the exhaust valves 34 and 35 from the camshaft 27.

From FIG. 1, it can be seen that the valves 19, 21, 34, 26 and 35 are spaced circumferentially from each other around the cylinder bore axis and that no two of the exhaust valves 34 and 35 are adjacent to each other. That is, each exhaust valve 34 and 35 and its respective seat is surrounded by a pair of intake valves so as to minimize the heat transfer between the exhaust valve seats and to make the thermal loading on the cylinder head 14 more uniform.

Although the invention has been described in conjunction with an engine having two exhaust valves and three intake valves per cylinder, the concept may be employed with engines having differing number of valves. Various other changes and modifications may be made without departing from the spirit and scope of the invention, as defined by the appended claims.

We claim:

1. In a valve arrangement for an internal combustion engine having a combustion chamber having a peripheral edge in plan view defining a closed curve, at least three intake valves serving said chamber, and at least two exhaust valves serving said chamber, the improvement comprising said valves being located so that their outer edges all lie adjacent said closed curve so that said valves lie on a closed curve spaced inwardly from the peripheral edge of said combustion chamber in plan view, no two of said exhaust valves being adjacent to each other around the closed curve upon which they lie.

2. In a valve arrangement as set forth in claim 1 wherein the combustion chamber has a circular cross-sectional configuration in plan view and the valves are circumferentially spaced from each other.

3. A valve arrangement as set forth in claim 2, wherein the circumferential spacing of the valves is such that no two exhaust valves are adjacent to each other in a circumferential direction.

4. In a valve arrangement for an internal combustion engine having a combustion chamber having a circular cross-sectional configuration in plan view, at least three intake valves serving said chamber, and at least two exhaust valves serving said chamber, the improvement comprising said valves being circumferentially spaced from each other and no two of said exhaust valves being adjacent to each other, two of the intake valves lie on one side of a plane containing the center of the combustion chamber and the other of the intake valves lies on the opposite side of the plane, the exhaust valves lying substantially on said other side of said plane.

5. In a valve arrangement as set forth in claim 4 further including a spark plug positioned centrally in the chamber.

6. In a valve arrangement as set forth in claim 5 wherein the intake passage serving the intake valve on the side opposite the plane extends through one surface of that side of the cylinder head and the exhaust passages extend through another surface of that side of the cylinder head.

7. A valve arrangement as set forth in claim 5, wherein the intake valves lie on opposite sides of a plane perpendicular to the first mentioned plane and passing through the center of the combustion chamber, the other of the intake valves being intersected by the perpendicular plane.

* * * * *